US005379668A

United States Patent [19]

Standing

[11] Patent Number: 5,379,668

[45] Date of Patent: Jan. 10, 1995

[54] TRIMMER BLOWER AND HIGH CAPACITY WASTE BIN

[75] Inventor: Robert C. Standing, Hilton, N.Y.

[73] Assignee: Xerox Corporation, Stamford, Conn.

[21] Appl. No.: 128,504

[22] Filed: Sep. 29, 1993

[51] Int. Cl.[6] ..... B26D 7/18

[52] U.S. Cl. ..... 83/99; 83/167; 83/365; 83/370

[58] Field of Search ..... 83/99, 98, 167, 370, 83/365

[56] References Cited

U.S. PATENT DOCUMENTS

| | | | |
|---|---|---|---|
| 2,769,495 | 11/1956 | Pomper et al. | 83/98 X |
| 3,103,842 | 9/1963 | Winkler et al. | 83/99 |
| 4,300,421 | 11/1981 | Yano et al. | 83/99 |
| 4,405,126 | 9/1983 | Frye et al. | 83/98 X |
| 4,976,089 | 12/1990 | Reichelt | 83/98 X |
| 5,036,737 | 8/1991 | Glaser | 83/98 X |

*Primary Examiner*—Kenneth E. Peterson
*Attorney, Agent, or Firm*—Kevin R. Kepner

[57] ABSTRACT

A signature booklet making apparatus for an electrophotographic printing machine, the booklet making machine having a trimmer blade blower and high capacity waste bin. Selectively operable air ducts are provided to distribute an airflow either across the trim blade to remove trim scraps or through a bypass duct to efficiently fill the waste bin with scrap. A valving mechanism responsive to the operation of the trimmer directs the airflow to the correct duct. By selectively causing the air to flow across the trim blade the chance of forcing thin booklets into the waste chute thereby causing jams is minimized.

16 Claims, 5 Drawing Sheets

TRIMMER BLOWER AND HIGH CAPACITY WASTE BIN

This invention relates generally to a signature booklet making machine, and more particularly concerns a trimming blade blower and high capacity waste bin for the signature booklet machine.

In a typical electrophotographic printing process, a photoconductive member is charged to a substantially uniform potential so as to sensitize the surface thereof. The charged portion of the photoconductive member is exposed to a light image to selectively dissipate the charges thereon in the irradiated areas, This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering electrostatically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high-speed commercial printing machine of the foregoing type, large volumes of unfinished sets of copy sheets are fed onto a stacking tray or from a discharge device such as that described in U.S. application Ser. No. 08/050,792, the relevant portions of which are herein incorporated by reference, to some sort of finishing apparatus. Such an apparatus is a signature booklet maker which center stitches the complied sheet set, folds the stitched set into a booklet and trims the edges of the booklet. It is desirable to clear the cutting area of the trimmings to likewise prevent jams and to minimize operator intervention. It is also desirable that the trimmings from the operation be gathered in some sort of high capacity container so as to prevent the need for frequent emptying of the waste bin by an operator.

The following disclosures may be relevant to various aspects of the present invention:

U.S. application Ser. No. 08/057,802

Applicant: Richards et al.

Filing Date: May 7, 1993

The relevant portions of the foregoing disclosures may be briefly summarized as follows:

U.S. application Ser. No. 08/057,802 describes a modified folding blade and a trimmer blade blower. The blower operates to eliminate build up of trim scrap at the blade.

In accordance with one aspect of the present invention, there is provided an apparatus for trimming sheets of the type having a blade and a waste bin. The apparatus comprises an airflow source and a first conduit operatively connecting the airflow source to the waste bin, the first conduit directing the airflow through a trimmer blade area so that trim scraps are forced into the waste bin by the airflow. A second conduit operatively connecting the airflow source to the waste bin so that airflow through the second conduit causes the waste bin to be filled efficiently with waste trimmings and a valve for selectively causing airflow from the airflow source through the first conduit and the second conduit are also provided.

Pursuant to another aspect of the present invention, there is provided an electrophotographic printing machine having a finishing station including a sheet set trimming device having a reciprocating blade and a trim waste bin. The Improvement comprises an airflow source and a first conduit operatively connecting the airflow source to the waste bin, the first conduit directing the airflow through a trimmer blade area so that trim scraps are forced into the waste bin by the airflow. A second conduit operatively connecting the airflow source to the waste bin so that airflow through the second conduit causes the waste bin to be filled efficiently with waste trimmings and a valve for selectively causing airflow from the airflow source through the first conduit and the second conduit are also provided.

Other features of the present invention will become apparent as the following description proceeds and upon reference to the drawings, in which.

Figure 3A:
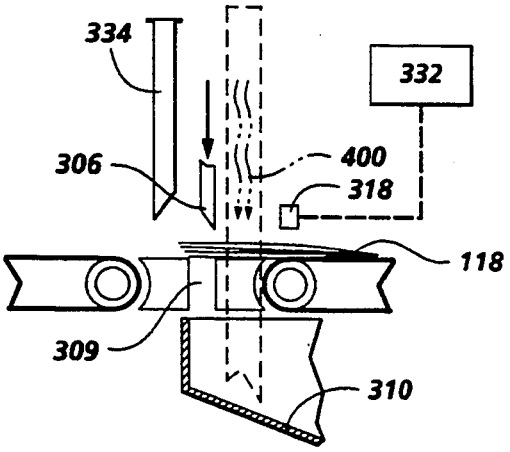
Figure 3B:
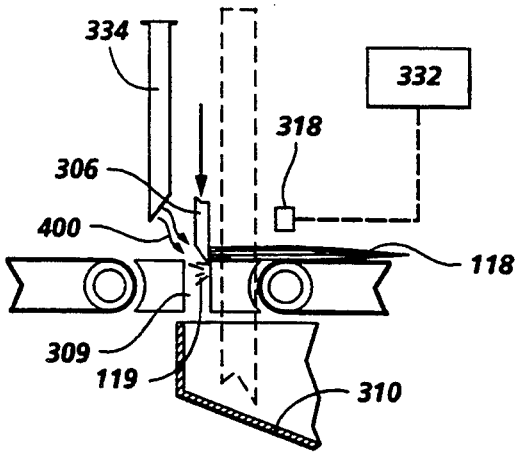
Figure 3C:
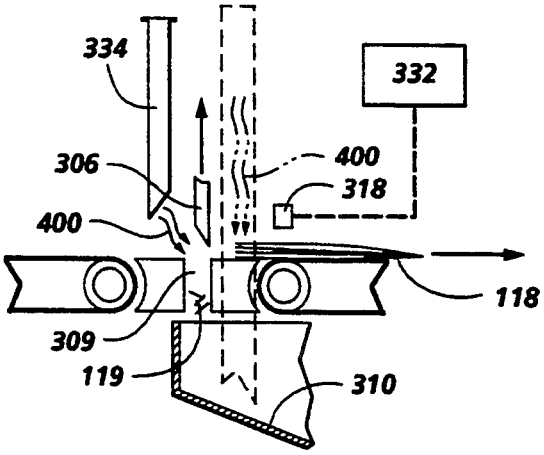
Figure 4:
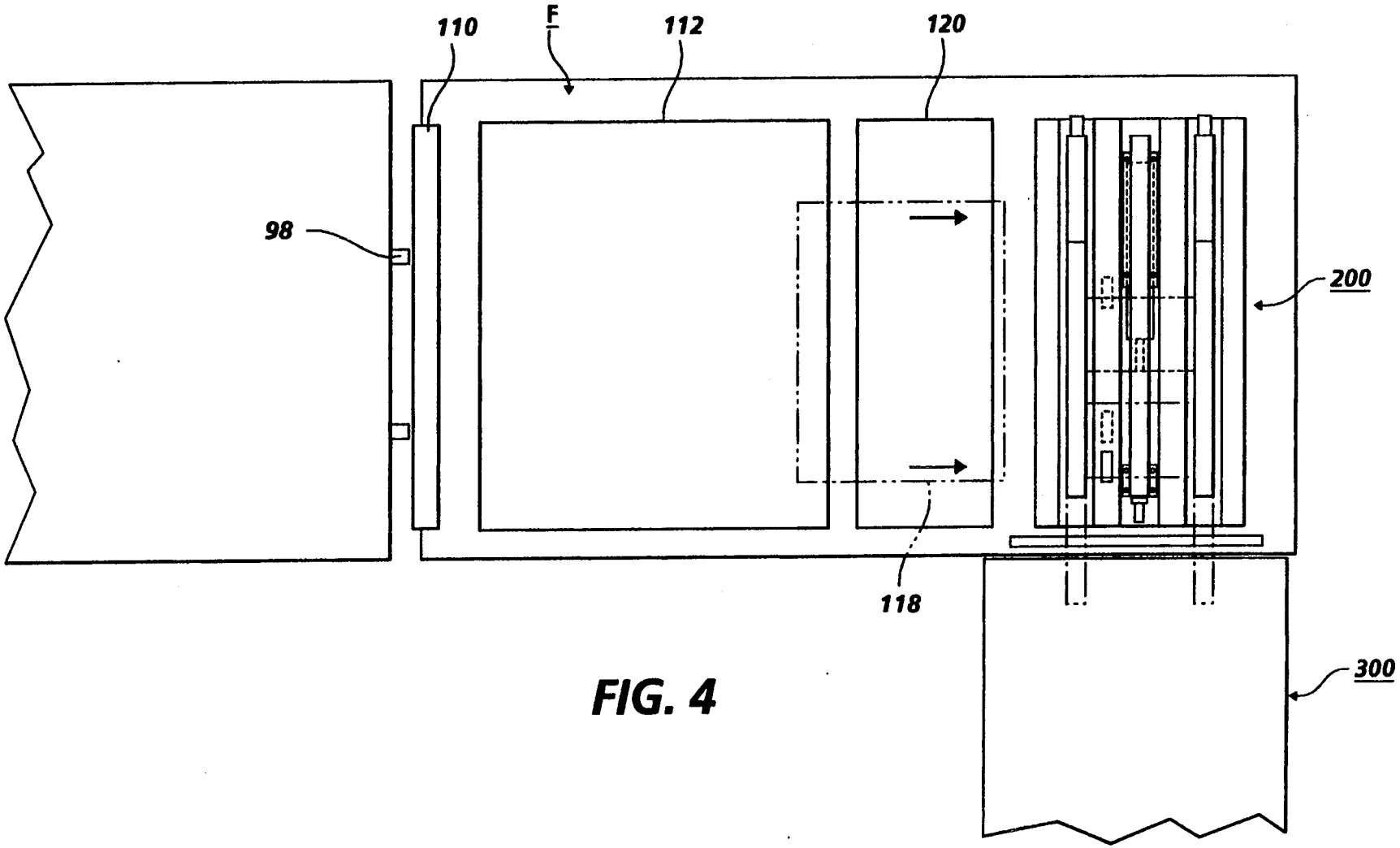
Figure 5:
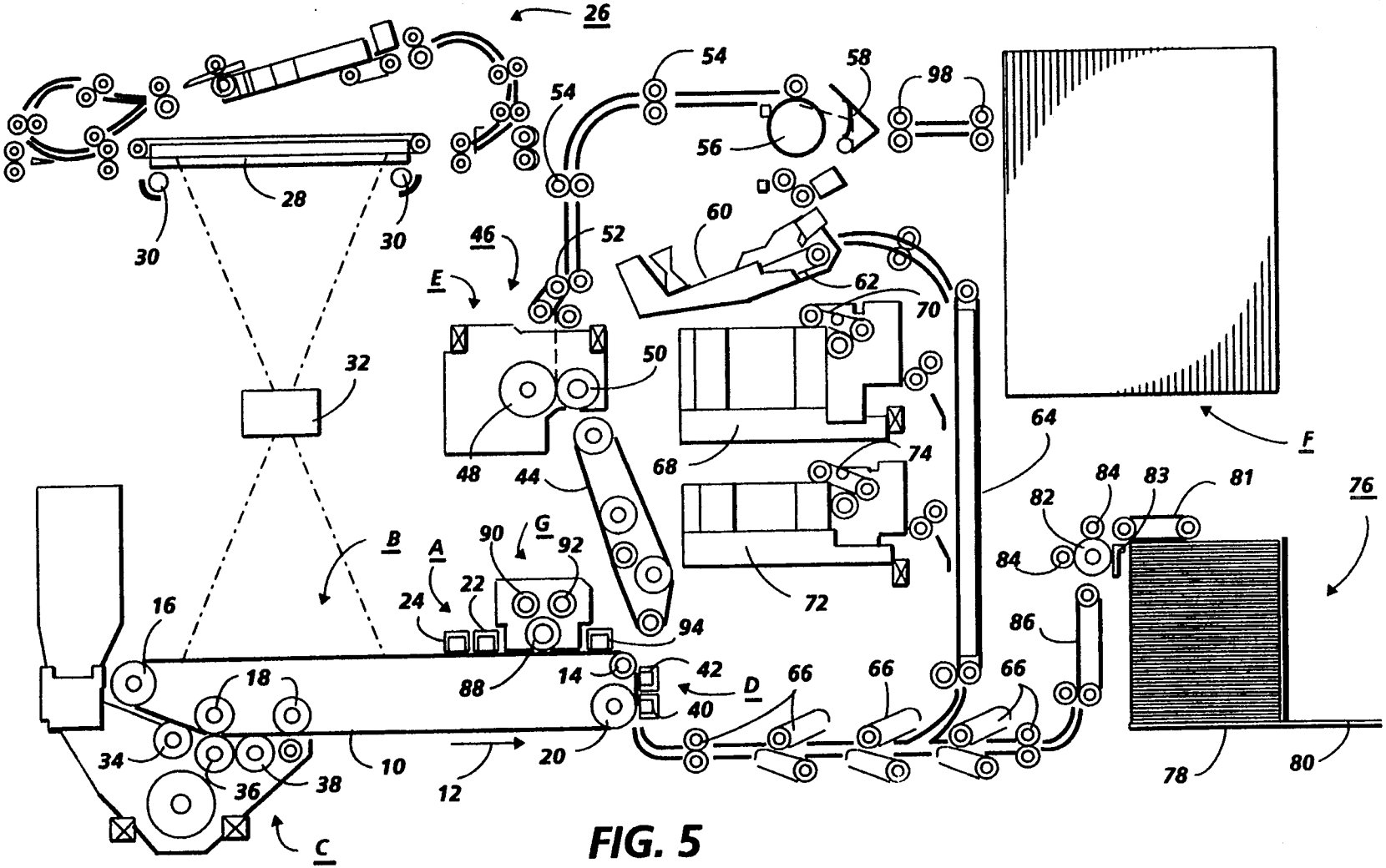

FIGS. 3A, 3B, and 3C illustrate a cycle of the trimmer blower and high capacity bin of the present invention;

FIG. 4 is a schematic plan view depicting the output section of an illustrative electrophotographic printing machine showing the input to a signature booklet making machine; and FIG. 5 is a schematic elevational view depicting an illustrative electrophotographic printing machine incorporating a finisher having a signature booklet making machine incorporating the trimmer blower and high capacity bin of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 5 schematically depicts an electrophotographic printing machine incorporating the features of the present invention therein. It will become evident from the following discussion that the trimmer blower and high capacity bin of the present invention may be employed in a wide variety of machines and is not specifically limited in its application to the particular embodiment depicted herein.

Referring to FIG. 5 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar TM. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station 13, a document handling unit indicated generally by the reference numeral 26 is positioned over platen 28 of the printing machine. Document handling unit 26 sequentially feeds documents from a stack of documents placed by the operator faceup in a normal forward collated order in the document stacking and holding tray. A document feeder located below the tray, forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of the document is achieved by lamps 30 which illuminate the document on a platen 28. Light rays reflected from the document are transmitted through the lens 32. Lens 32 focuses light images of the document onto the charged portion of the photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS. Other types of imaging systems may also be used employing, for example, a pivoting or shiftable LED write bar or projection LCD (liquid crystal display) or other electro-optic display as the "write" source.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detach the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curt in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets can be attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 facedown on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or clown. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. The high capacity sheet feeder, indicated generally by the reference numeral 76, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D.

Invariably, after the copy sheet is separated from The photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected.

Figure 1:
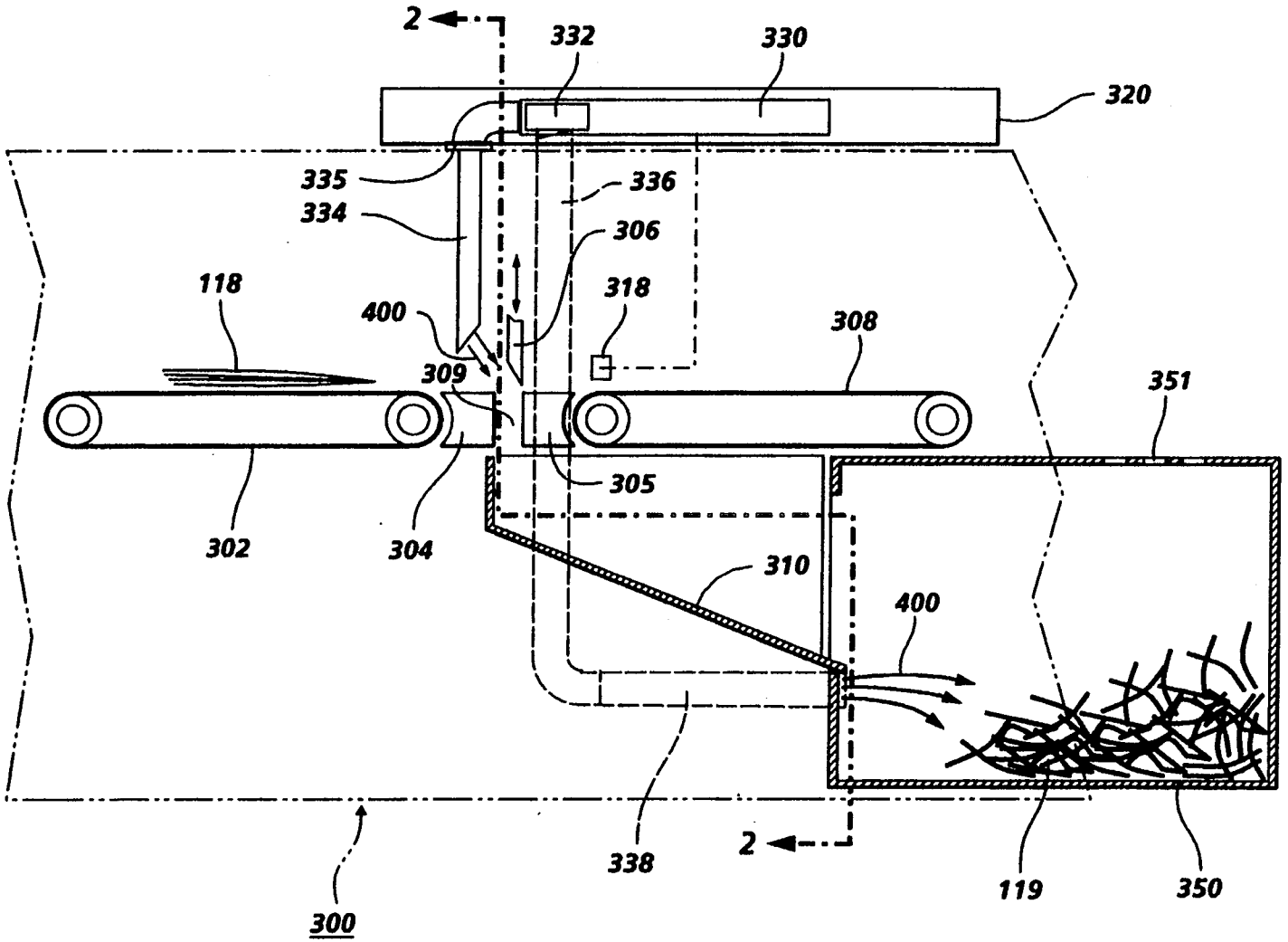
FIG. 1 is a schematic view of a signature booklet making machine trimmer section incorporating the invention herein.

Turning now to FIG. 1, the general operation of the trimmer blade blower and high capacity waste bin is illustrated and will be described. After having been discharged from the printing machine by the discharge device 200 (FIG. 4) a set of sheets 118 is center stitched by means of a stapler or other binding device and folded along the stitch line to form a booklet thereof. The folded booklet 118 is then transported by booklet transport 302 to the trimming blade area. The booklet 118 is forwarded along transport 302 across anvils 304 and 305 onto the transport 308. Between the cutting anvils 304 and 305 there is a chute 309 for waste trimmings removal. The set is transported onto transport 308 folded edge first, so that the uneven sheet edges opposite the fold are aligned with the trim anvil 305.

A sensor 318 detects when the booklet is in the cutting area. When the booklet is properly positioned in the cutting area and sensed by sensor 318, the blade 306 is actuated and moves in a downward motion to trim the edges opposite the fold of the booklet to present an even edged booklet. Transport 308 then forwards the booklet to a collection device or other finishing area.

Figure 2:
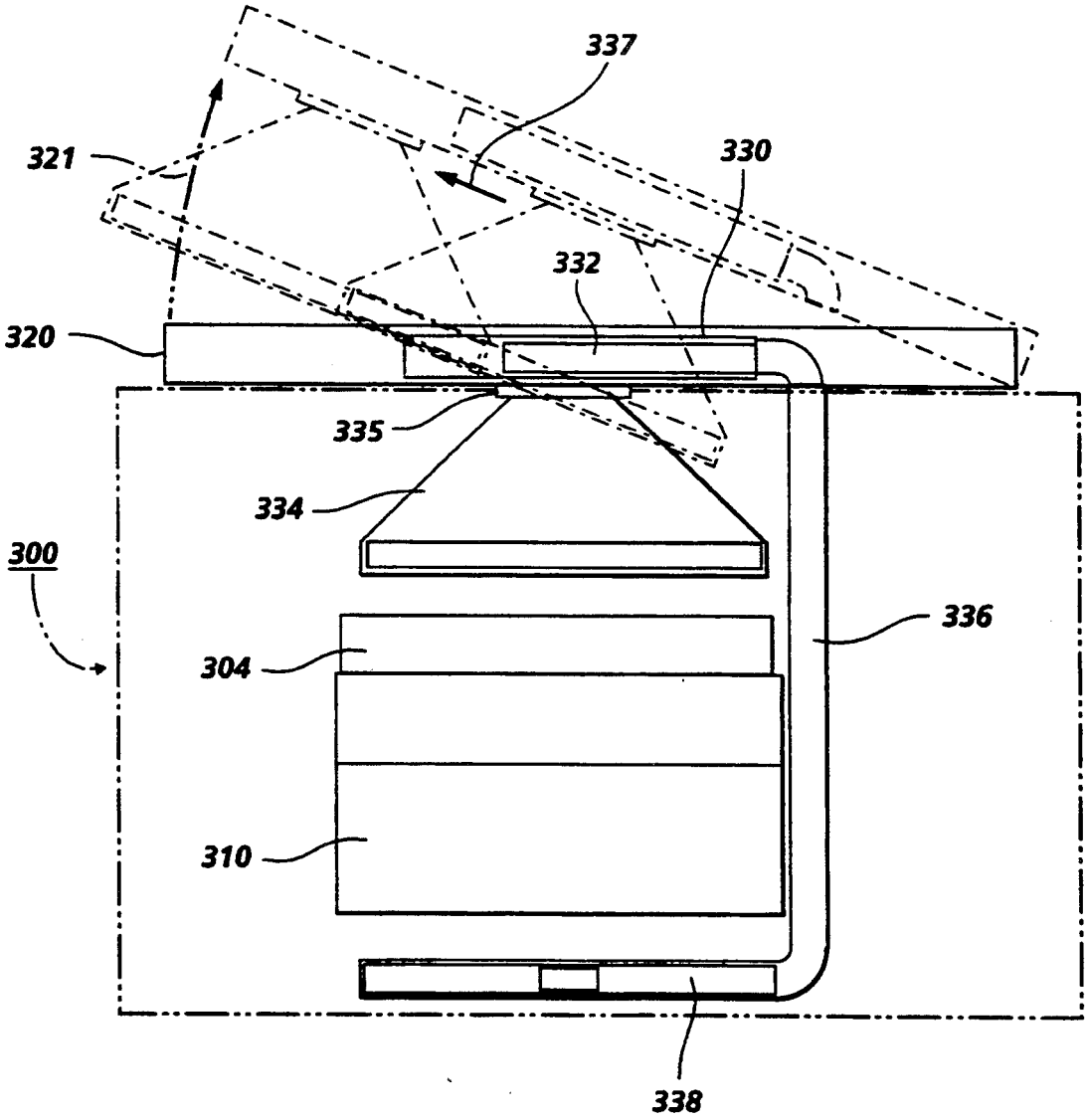
FIG. 2 is a view along the line in the direction of arrows A—A of FIG. 1.

The trimming blower 330 is mounted in the cover 320 of the signature booklet maker device 300. The blower 330 is typically a well known electric powered fan can be constantly operating. The air flow is directed by a valve 332 through either the ductwork 336 which bypasses the trim blade 306 and discharges the flow of air into the waste trim bin 350 (see FIGS. 1 and 2) or it is directed through the trim blade baffle or diffuser 334. The cover 320 on the machine 300 is hinged so that it may be lifted to remove paper jams when necessary. Accordingly, the blade diffuser 334 is also removable so as to not hinder jam clearance efforts. This is accomplished by having a lip formed into the top of the diffuser 334 which slides in a channel 335 in the bottom of the cover. Thus as shown in FIG. 2, the cover can be raised in the direction indicated by arrow 321 and the trim blade diffuser 334 can be removed by sliding it in the direction of arrow 337. The diffuser is replaced by simply reversing the above steps.

FIGS. 3A, 3B, and 3C schematically illustrate the sequence of air flow during the booklet trimming cycle. Turning first to FIG. 3*a*, the booklet is shown arriving at the cutting area. Prior to the booklet 118 arriving at the cutting area, the air flow indicated generally by dotted arrows 400 is directed through the bypass duct 336. When the booklet arrives at the cutting station, sensor 318 determines that the booklet 118 is in position to be trimmed. A signal is emitted by sensor 318 which activates the cutting blade 306 and also controls the air valve 332 so that the air flow is then directed through the blade diffuser 334. This air flow is representatively illustrated in FIG. 3B.

As can be seen in FIG. 3B, as the cutting blade trims off the excess edges 119 of the booklet 118, the air flow in bypass 336 can be turned off and the air directed out of diffuser 334 so that the trim particles 119 are directed through the waste chute 309 and along the waste ramp 310 into the waste bin 350 (shown in FIG. 1). As the cutting blade 306 is then raised as illustrated in FIG. 3C, the airflow can then be directed both through diffuser 334 and through bypass 336 so that the trimmings are blown down the waste chute, along the ramp, and into waste bin 350. The purpose of the bypass duct 336 and the diffuser 338 at the end of the bypass is to ensure that the trim particles are blown back fully into the trim waste bin 350 so that the full capacity of the bin can be realized. The bin 350 has a vent 351 so as to promote proper airflow through the bin to maximize capacity. Additionally, there should be some sort of seal provided to prevent air leaks between the diffuser 338 and the bin 350. A magnetic refrigerator type seal is very well suited for this purpose.

Without such an air assist, it is likely that trimmings would jam up either the waste chute 309, the ramp 310, or that the bin 350 would become stopped up right at the discharge of the ramp, and operator intervention would be required to clear the waste jam. By use of the present air directive system, a rather large waste bin can be utilized and operator intervention may be necessary only once per working shift, or at the very least, only once every several hours, depending upon the output of he printing machine. Once the booklet 118 is no longer sensed by the sensor 318, the signal is sent to valve 332 so that the air flow through diffuser 334 is terminated. This is necessary because If the signature booklet is very thin and the air flow through diffuser 334 is constantly operational, it is possible that the entire booklet that is so be trimmed can be blown down into the waste chute or partially into the waste chute, creating paper jams and hindering effective operation of the trimmer and associated printing machinery.

The relationship between the set ejector mechanism 200, the other components of finishing station F and the signature booklet making machine is illustrated in FIG. 4. In operation, sheets are discharged from the electrophotographic printing machine, compiled into sets, transported to the set ejector/elevator and individually ejected to an off-line finishing device 300. The sheets are first discharged through discharge rollers 98 to sheet transport 110. The sheets are then compiled into a set in one of the compiling bins 112, (114, 116 not shown). A set of compiled sheets 118 is transported by transport 120 to the set ejector mechanism 200

In recapitulation, there is provided a signature booklet making apparatus for an electrophotographic printing machine, the booklet making machine having a trimmer blade blower and high capacity waste bin. Selectively operable air ducts are provided to distribute an airflow either across the trim blade to remove trim scraps or through a bypass duct to efficiently fill the waste bin with scrap. A valving mechanism responsive to the operation of the trimmer directs the airflow to the correct duct. By selectively causing the air to flow across the trim blade the chance of forcing thin booklets into the waste chute thereby causing jams is minimized.

It is, therefore, apparent that there has been provided in accordance with the present invention, a trimming blade blower and high capacity waste bin that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim

1. An apparatus for trimming sheets of the type having a trimmer blade and a waste bin, comprising:

an airflow source;

a first conduit operatively connecting said airflow source to a trimmer blade area, said first conduit directing the airflow through the trimmer blade area so that trim scraps are forced into said waste bin lay the airflow;

a second conduit operatively connecting said airflow source to the waste bin so that airflow through said second conduit causes the waste bin to be filled efficiently with waste trimmings; and a valve for alternating airflow between said first conduit and said second conduit.

2. An apparatus as described in claim 1, wherein said valve, in response to the trimmer blade being positioned at a non-cutting position, couples said airflow source to said second conduit, and in response to the blade being at a cutting position, couples said airflow source to said first conduit.

3. An apparatus as described in claim 1, further including a set detector adapted to emit a signal, in response to a set of sheets being in position to be trimmed.

4. An apparatus as described in claim 3, wherein said valve, in response to the trimmer blade being positioned at a non-cutting position, couples said airflow source to said second conduit, and in response to the blade being at a cutting position, couples said airflow source to said first conduit.

5. An apparatus as described in claim 3, wherein said set detector includes an optical sensor adapted to determine when a set of sheets is in a position to be cut and emitting a signal indicative thereof.

6. An apparatus as described in claim 5, wherein said valve, in response to the trimmer blade being positioned at a non-cutting position, couples said airflow source to said second conduit, and in response to the blade being at a cutting position, couples said airflow source to said first conduit.

7. An apparatus as described in claim 6, wherein said valve causes airflow to be directed into both said first conduit and said second conduit when the set is in the trimming position.

8. An apparatus as described in claim 1, wherein said first conduit comprises:

a waste chute connecting the waste bin to the blade trim area; and an air passage connecting said airflow source to the trimmer blade area.

9. An electrophotographic printing machine having a finishing station including a sheet set trimming device having a trimmer blade and a trim waste bin, comprising:

an airflow source;

a first conduit operatively connecting said airflow source to a trimmer blade area, said first conduit directing the airflow through the trimmer blade area so that trim scraps are forced into said waste bin by the airflow;

a second conduit operatively connecting said airflow source to the waste bin so that airflow through said second conduit causes the waste bin to be filled efficiently with waste trimmings; and a valve for alternating airflow between said first conduit and said second conduit.

10. A printing machine as described in claim 9, wherein said valve, in response to the trimmer blade being positioned at a non-cutting position, couples said airflow source to said second conduit, and in response to the blade being at a cutting position, couples said airflow source to said first conduit.

11. A printing machine as described in claim 9, further including a set detector adapted to emit a signal, in response to a set of sheets being in position to be trimmed.

12. A printing machine as described in claim 11, wherein said valve, in response to the trimmer blade being positioned at a non-cutting position, couples said airflow source to said second conduit, and in response to the blade being at a cutting position, couples said airflow source To said first conduit.

13. A printing machine as described in claim 11, wherein said set detector includes an optical sensor adapted to determine when a set of sheets is in a position to be cut and emitting a signal indicative thereof.

14. A printing machine as described in claim 13, wherein said valve, in response to the trimmer blade being positioned at a non-cutting position, couples said airflow source to said second conduit, and in response to the blade being at a cutting position, couples said airflow source to said first conduit.

15. A printing machine as described in claim 14, wherein said valve causes airflow to be directed into both said first conduit and said second conduit when the set is in the trimming position.

16. A printing machine as described in claim 9, wherein said first conduit comprises:

a waste chute connecting the waste bin to the trimmer blade area; and an air passage connecting said airflow source to the trimmer blade area.

* * * * *